US007896096B2

(12) United States Patent
Ferrand

(10) Patent No.: US 7,896,096 B2
(45) Date of Patent: Mar. 1, 2011

(54) HYDRAULIC DRILLING MACHINE FOR WORKING IN A SMALL SPACE

(75) Inventor: Patrick Ferrand, Montipouret (FR)

(73) Assignee: I.A.T.S.T., Montipouret (FR)

( * ) Notice: Subject to any disclaimer, the term of this patent is extended or adjusted under 35 U.S.C. 154(b) by 0 days.

(21) Appl. No.: 12/178,840

(22) Filed: Jul. 24, 2008

(65) Prior Publication Data

US 2009/0032277 A1 Feb. 5, 2009

Related U.S. Application Data

(63) Continuation of application No. 11/182,079, filed on Jul. 15, 2005, now Pat. No. 7,478,685.

(30) Foreign Application Priority Data

Jul. 15, 2004 (FR) ..... 04 07856

(51) Int. Cl.
*E21B 19/08* (2006.01)

(52) U.S. Cl. ..... 173/34; 173/33; 173/185

(58) Field of Classification Search ..... 173/34, 173/27, 159, 185, 29, 31, 32, 33, 35, 36; 175/62, 162, 121; 405/138, 143; 254/29 R
See application file for complete search history.

(56) References Cited

U.S. PATENT DOCUMENTS

| | | | | |
|---|---|---|---|---|
| 3,203,737 | A | 8/1965 | Winberg et al. | |
| 3,242,877 | A * | 3/1966 | Hirst et al. | 105/136 |
| 4,368,873 | A | 1/1983 | Perry | |
| 4,542,796 | A * | 9/1985 | Delbarre | 175/19 |
| 5,540,292 | A | 7/1996 | Behrens | |
| 5,810,101 | A | 9/1998 | Caraway et al. | |
| 6,109,831 | A | 8/2000 | Handford | |
| 6,149,349 | A | 11/2000 | Nikiforuk et al. | |
| 6,179,068 | B1 | 1/2001 | West | |
| 6,202,758 | B1 | 3/2001 | Jenne | |
| 6,481,507 | B1 | 11/2002 | Kromray, Jr. | |

* cited by examiner

*Primary Examiner*—Rinaldi I Rada
*Assistant Examiner*—Nathaniel Chukwurah
(74) *Attorney, Agent, or Firm*—Lowe Hauptman Ham & Berner LLP

(57) ABSTRACT

A hydraulic drilling machine has a metal chassis shaped as a rectangular parallelepiped, drilling resources located at the front of the chassis, a rotary motor to drive drilling rods, and a hydraulic circuit. An electrical circuit powers the various components of the drilling machine. The machine can be mounted on the arm of a hydraulic mini-digger and operate without an extra hydraulic unit.

8 Claims, 12 Drawing Sheets

HYDRAULIC DRILLING MACHINE FOR WORKING IN A SMALL SPACE

RELATED APPLICATIONS

The present application is a continuation of U.S. patent application Ser. No. 11/182,079, filed Jul. 15, 2005, which is based on, and claims priority from, FR Application Number 0407856, filed Jul. 15, 2004, the disclosures of which are hereby incorporated by reference herein in their entireties.

RELATED APPLICATIONS

The present application is based on, and claims priority from, French Application Serial Number 04 07856, filed Jul. 15, 2004, the disclosure of which is hereby incorporated by reference herein in its entirety.

FIELD OF THE INVENTION

This present invention concerns a hydraulic drilling machine for working in a small space and suitable for being mounted on a mini-digger, digger, tractor-mounted digger, mini loader, loader, crane truck, etc.

BACKGROUND OF THE INVENTION

Standard hydraulic drilling machines are familiar in existing technology, but never mounted on mini-diggers.

This is the type of drilling machine described by U.S. Pat. No. 5,810,101 with a drilling machine that has a metal chassis, drilling resources, a rotary motor used when drilling, a hydraulic circuit and a electrical circuit. The chassis is secured by its centre to the arm of the digger. The drilling rods are rods with a helical borer and therefore cannot be extended. In this type of drilling machine, drilling is therefore limited to the length of the drilling rod. This drilling machine is intended to be used only with conventional diggers of normal size and not with mini-diggers.

Such drilling machines have several drawbacks. In fact, such drilling machines are not easy to handle. This is due to the fact that they are mounted on excavation chassis or on tracks.

This handling difficulty leads to the digging of trenches that are often wide and deep, this being necessary for the execution of the works, but which disrupt the life of a district or interfere with the traffic.

Such machines cannot be used in small spaces such as alongside safety railings, pavements or embankments, for example.

U.S. Pat. No. 6,179,068 proposes a drilling machine whose size is adaptable by virtue of a portion which can be removed to allow access to confined and small spaces. But as in the previous case, the rod cannot be extended.

SUMMARY OF THE INVENTION

The purpose of this present invention is to overcome certain drawbacks of previous designs by proposing a hydraulic drilling machine of small size and suitable for working in the most varied positions, including in or out of excavation bottoms, while still retaining a working power that is identical to the drilling machines of a larger format.

This aim is realised by a hydraulic drilling machine composed of a metal chassis in the shape of a rectangular parallelepiped, of drilling resources located at the front of the chassis, a rotary motor to drive the rods during the drilling operation, a hydraulic circuit and an electrical circuit powering the various components of the drilling machine, characterised in that it can be mounted on the arm of a hydraulic mini-digger and can operate without the addition of an extra hydraulic unit.

According to another particular feature, the width of the chassis is approximately equal to one third of its length.

According to another particular feature, the chassis of the drilling machine is connected to the arm of the mini-digger by a turret providing drilling machine with a rotation movement around the axis of the arm of the mini-digger.

According to another particular feature, at least two rings are attached, one above the other, on one of the uprights of the chassis and capable of receiving the fixing lugs of a basket used for storage of the drilling rods.

According to yet another particular feature, the basket is composed of three U-shaped metal bands placed approximately parallel to each other and connected by cross-pieces placed approximately perpendicular to the metal bands, a fixing lug for securing the basket onto the chassis by means of the rings being fixed onto each of the cross-pieces.

Again, according to a particular feature, the drilling resources consist of a drill-bit guide along which slides a guillotine operated in two slides by a guillotine jack, the whole constituting a system for locking and unlocking the drilling rods.

According to another particular feature, the drill-bit guide is a metal part of rectangular shape equipped at its centre with a bore allowing the passage of the drilling rods, this guide being fixed in the bottom part of one of the widths of the chassis at the height of the cross-pieces.

According to another particular feature, the guillotine is a part of rectangular shape presenting, on one of its lengths, two teeth separated by a space of a size that is approximately equal to that of the diameter of a drilling rod, so that the drilling rods are locked between the teeth thus making it easy to manipulate them.

According to another particular feature, the guillotine is positioned approximately parallel to the drill-bit guide in such a way that it rub up against the latter.

According to another particular feature, the guillotine is operated by a jack whose first extremity is fixed to the length of the guillotine which has no teeth, and the second to a cross-member of the chassis.

According to another particular feature, the guillotine slides along slides attached along the uprights of the chassis which have an H-shaped section.

According to another particular feature, the cross-pieces located in the bottom part of the chassis outline a frame in which is fitted a bottom chassis composed of two cross-pieces placed approximately parallel to each other and connected together by the drill-bit guide at one of their extremities and by a metal plate equipped with a hole intended to reduce the weight of the plate at the other.

According to another particular feature, the rotary motor is fixed onto a support composed of a metal plate equipped along each of its lengths with a lug fitted with two ball bearings located on either side of the axis of symmetry of the lugs.

According to another particular feature, each lug is fitted with a rectangular part fixed in the extension of one of the widths of the lug the purpose of which is to prevent the support of the rotary motor from derailing when it slides along the cross-members of the internal chassis.

According to another particular feature, the sliding action of the rotary motor support is generated by three jacks placed approximately parallel to each other in the same horizontal plane and head to foot.

According to another particular feature, the jacks are connected together in a rigid manner by three metal parts of circular section and in the shape of a U, and by at least four cross-members on which the metal plate rests.

According to another particular feature, when it is in working position, the chassis of the drilling machines is stabilized by means of two jacks placed along the cross-members and fixed to the latter by means of a metal plate and rings.

According to another particular feature, the free extremity of the jacks is composed of a sphere clamped into a cylindrical part equipped with a conduit used for greasing the sphere.

According to another particular feature, the hydraulic system of the drilling machine is fitted with three entry points for the oil in coming from the hydraulic system of the mini-digger, with the third entry point used to increase the working power of the components of the drilling machine.

According to another particular feature, the hydraulic system of the drilling machine is fitted with a quarter-turn valve used to feed either the rotary motor or the other elements participating in the operation of the drilling machine.

According to another particular feature, the electrical system of the drilling machine is connected to the control panel of the mini-digger. This system includes an emergency stop switch and a power feed for a working lamp connected to the cigar lighter of the chassis.

According to another particular feature, a power feed intended for the system electronics is provided as a take-off from the power feed of the working lamp.

The above and still further objects, features and advantages of the present invention will become apparent upon consideration of the following detailed description of a specific embodiment thereof, especially when taken in conjunction with the accompanying drawings.

DETAILED DESCRIPTION OF THE DRAWINGS

Figure 1:
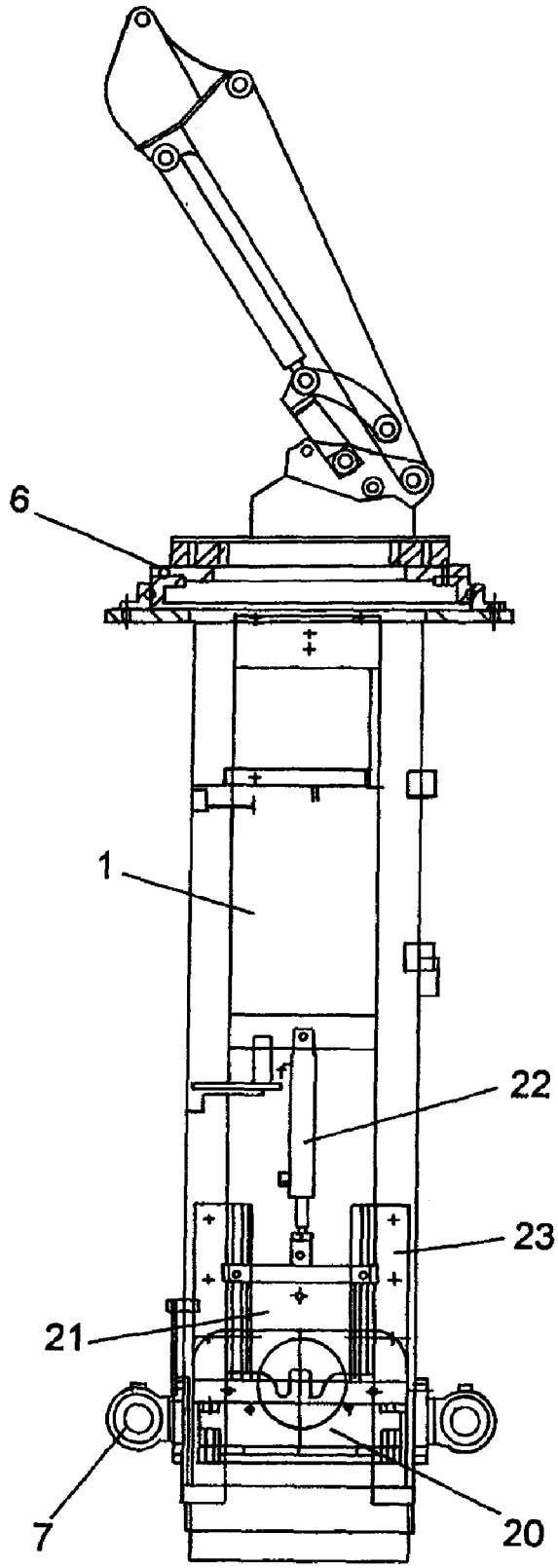
FIG. 1 is a general front view of the drilling machine according to a preferred embodiment of the invention when it is attached to the arm of a hydraulic mini-digger.
Figure 2:
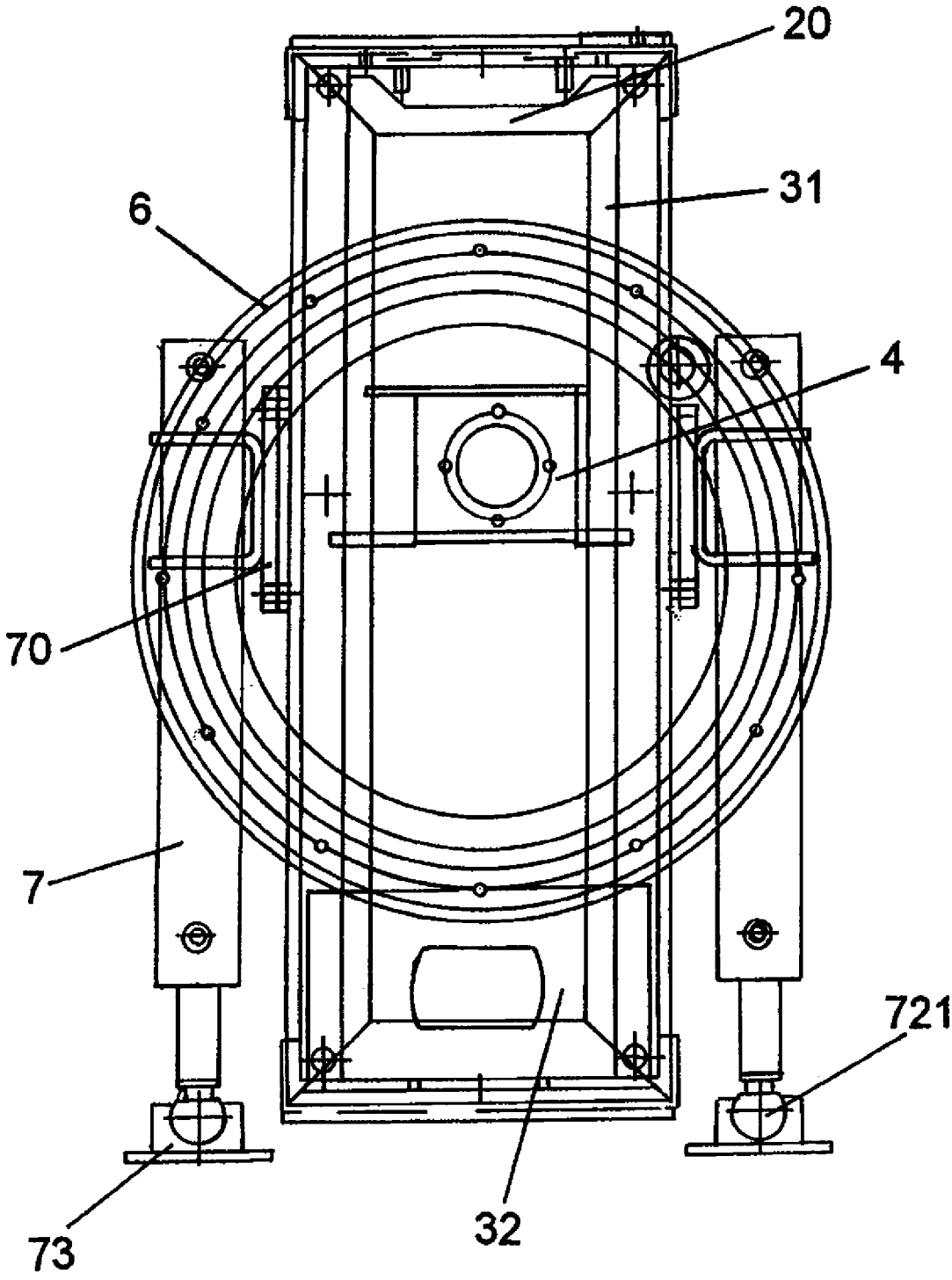
FIG. 2 is a plan view of the drilling machine according to a preferred embodiment of the invention.
Figure 3:
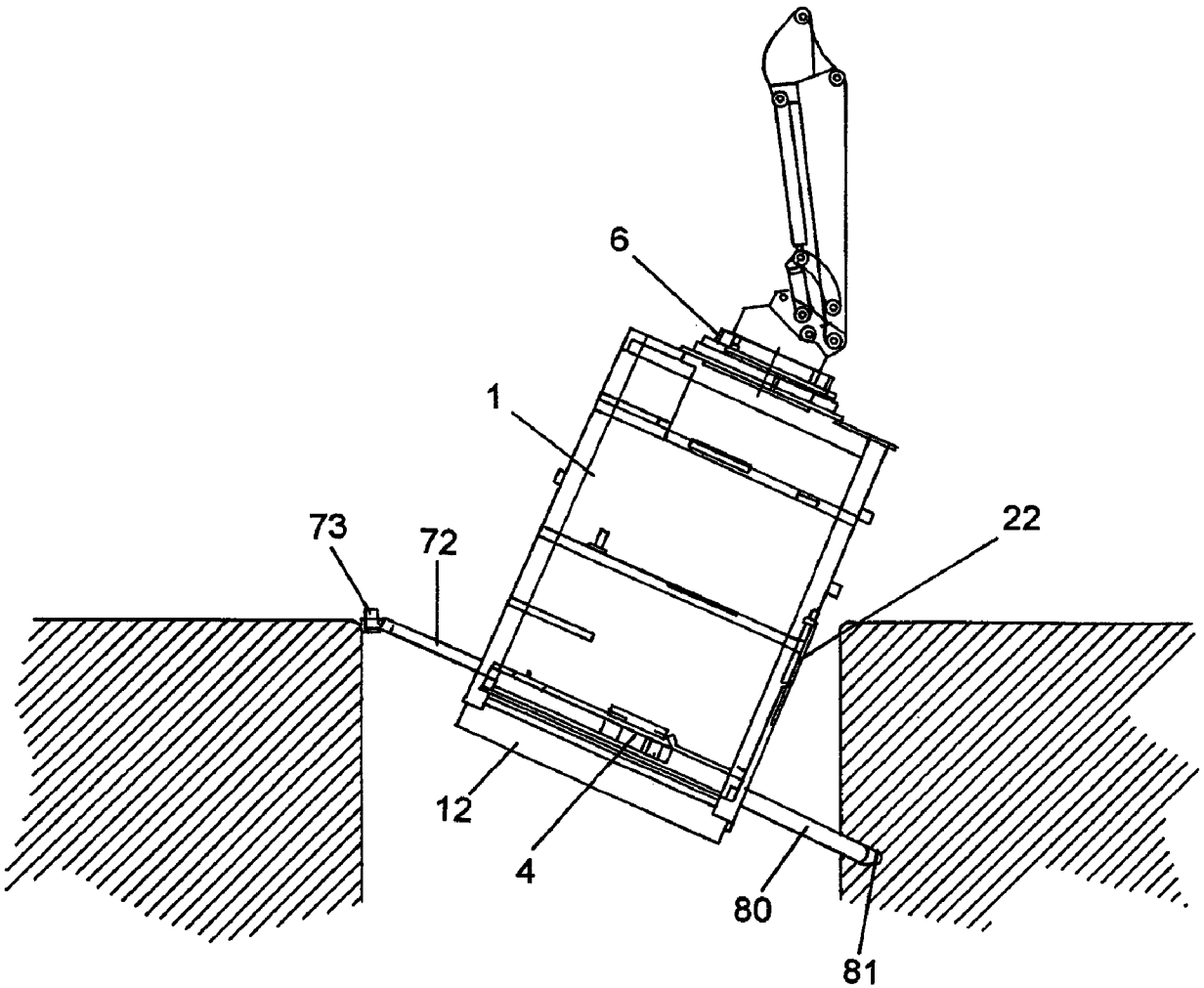
FIG. 3 is a view in profile of the drilling machine according to a preferred embodiment of the invention, in a working position.
Figure 4C:
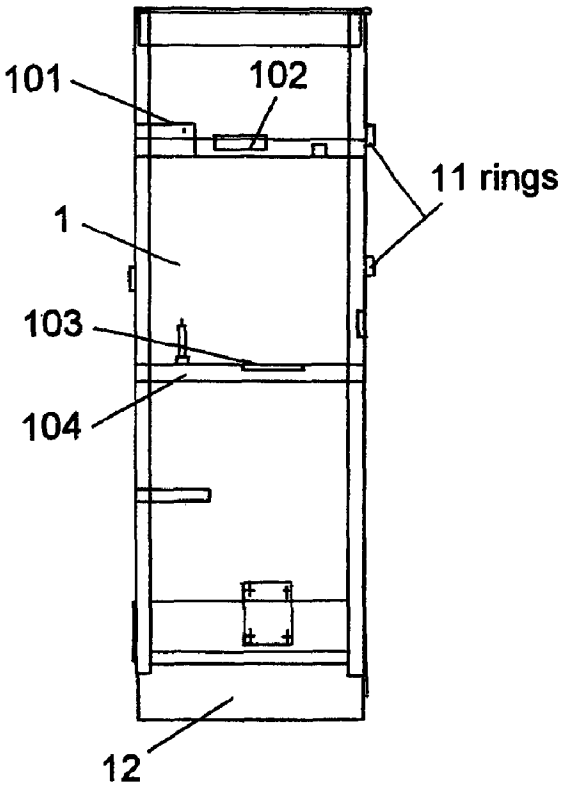
FIG. 4*b* is a front view and FIG. 4*c* is a plan view of the chassis of the drilling machine according to a preferred embodiment of the invention.
Figure 4B:
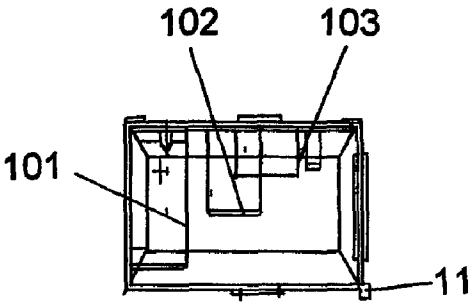
Figure 4A:
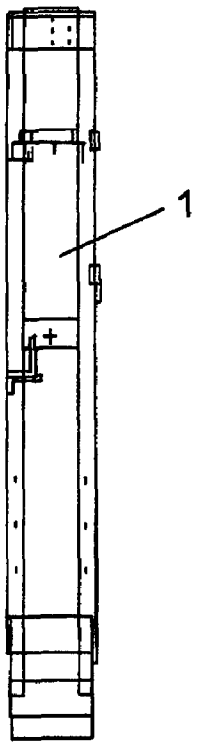
FIG. 4*a* is a view in profile.
Figure 5:
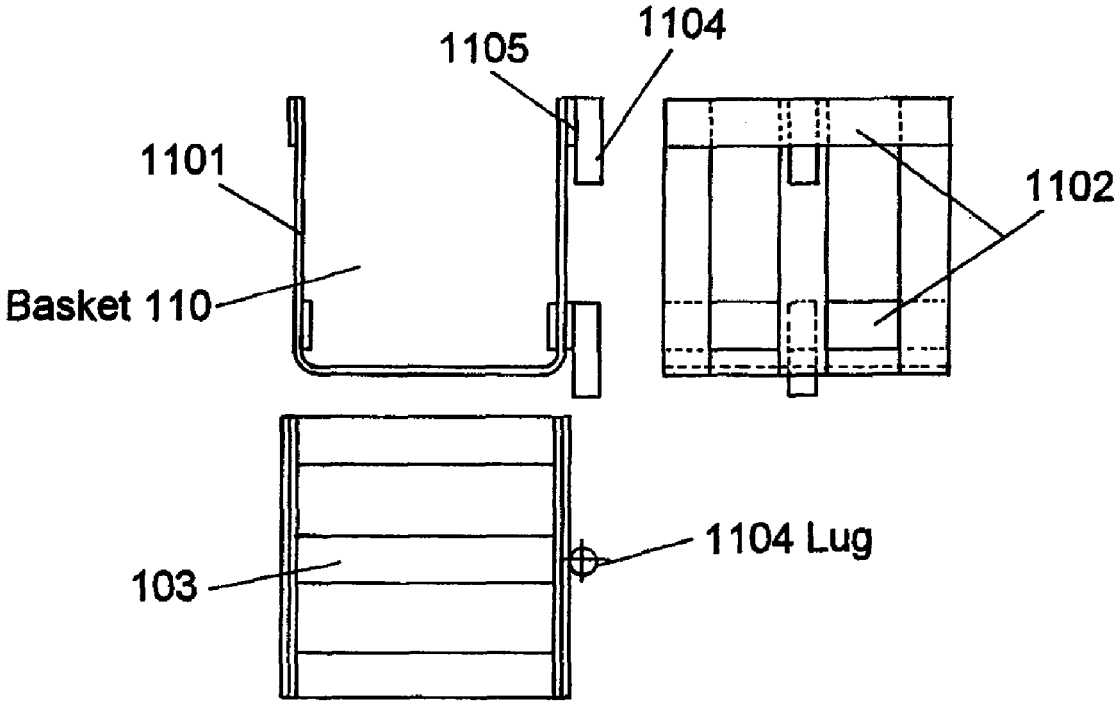
FIG. 5 is a view in profile, a front view, and a plan view of the rod basket.
Figure 6:
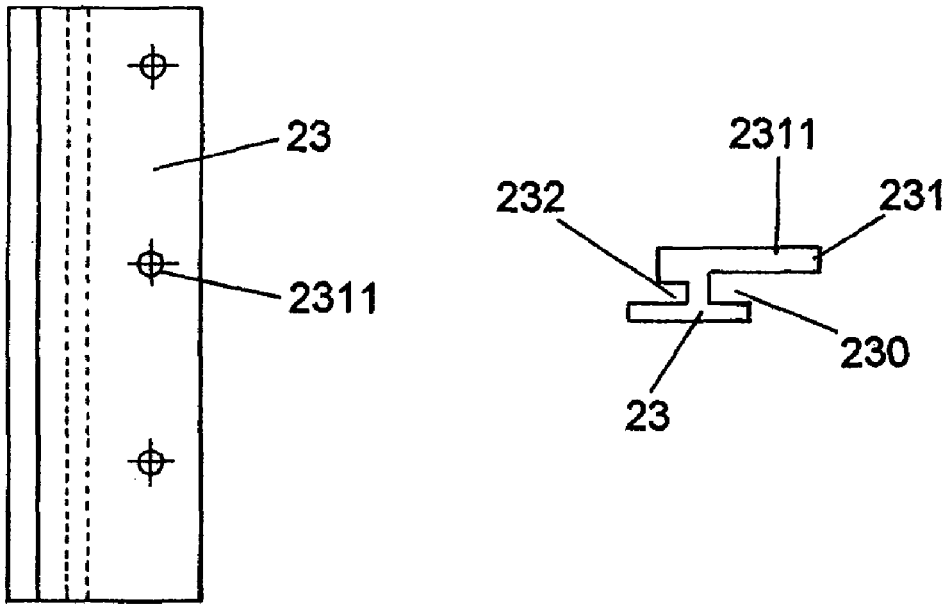
FIG. 6 is a front view and in section of a slide.
Figure 7:
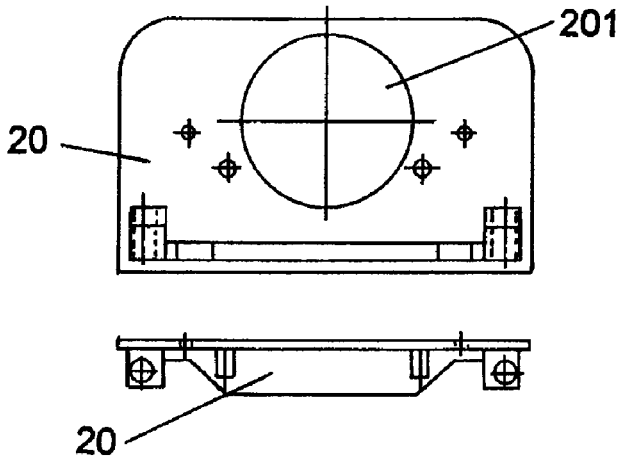
FIG. 7 is a front view and a view in section of the drill-bit guide.
Figure 8:
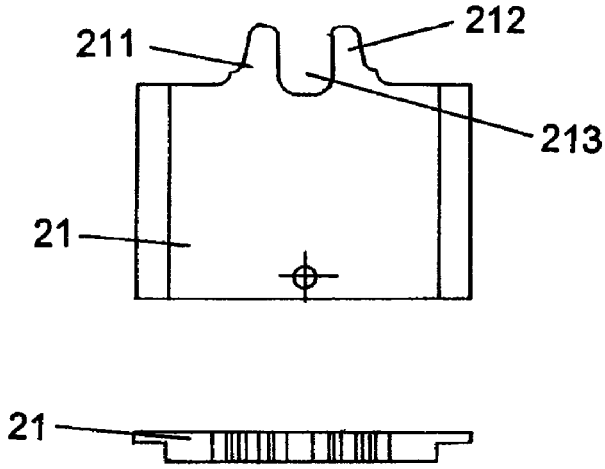
FIG. 8 is a front view and a view in section of the guillotine.
Figure 9:
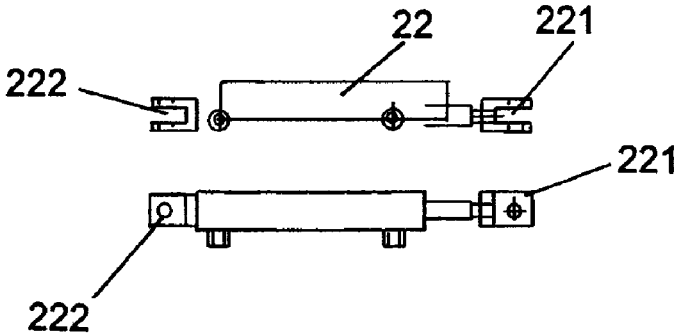
FIG. 9 is a front view and profile view of the guillotine jack.
Figure 11:
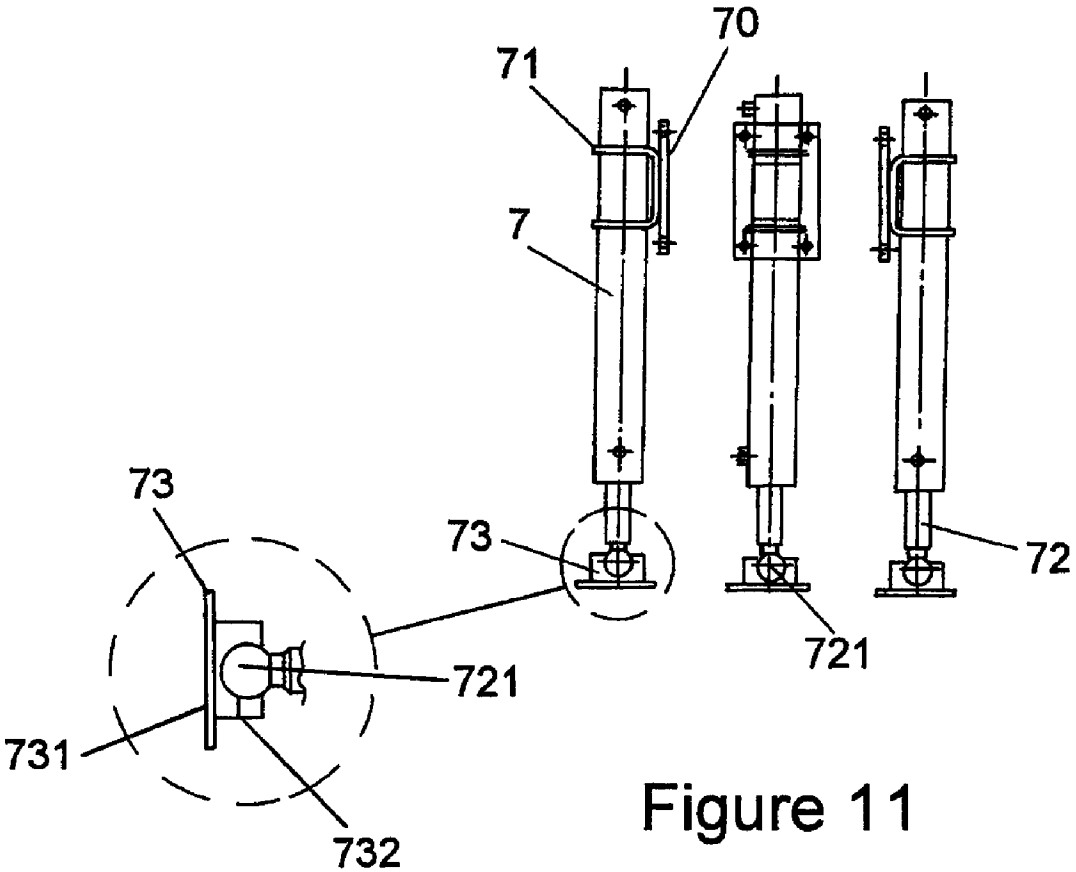
FIG. 11 is a profile and front view of the support devices as well as an enlargement of the extremity of the support devices.
Figure 10:
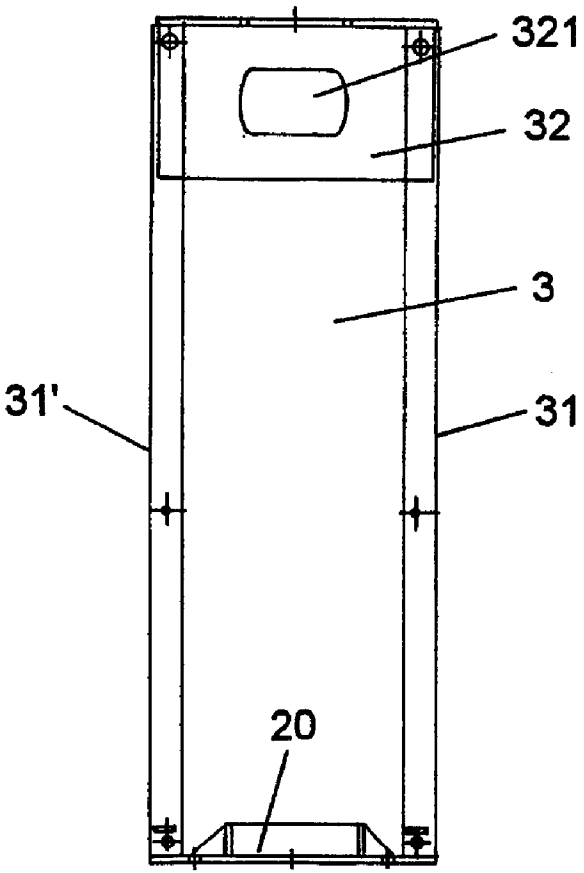
FIG. 10 is a plan view of the bottom chassis.
Figure 12:
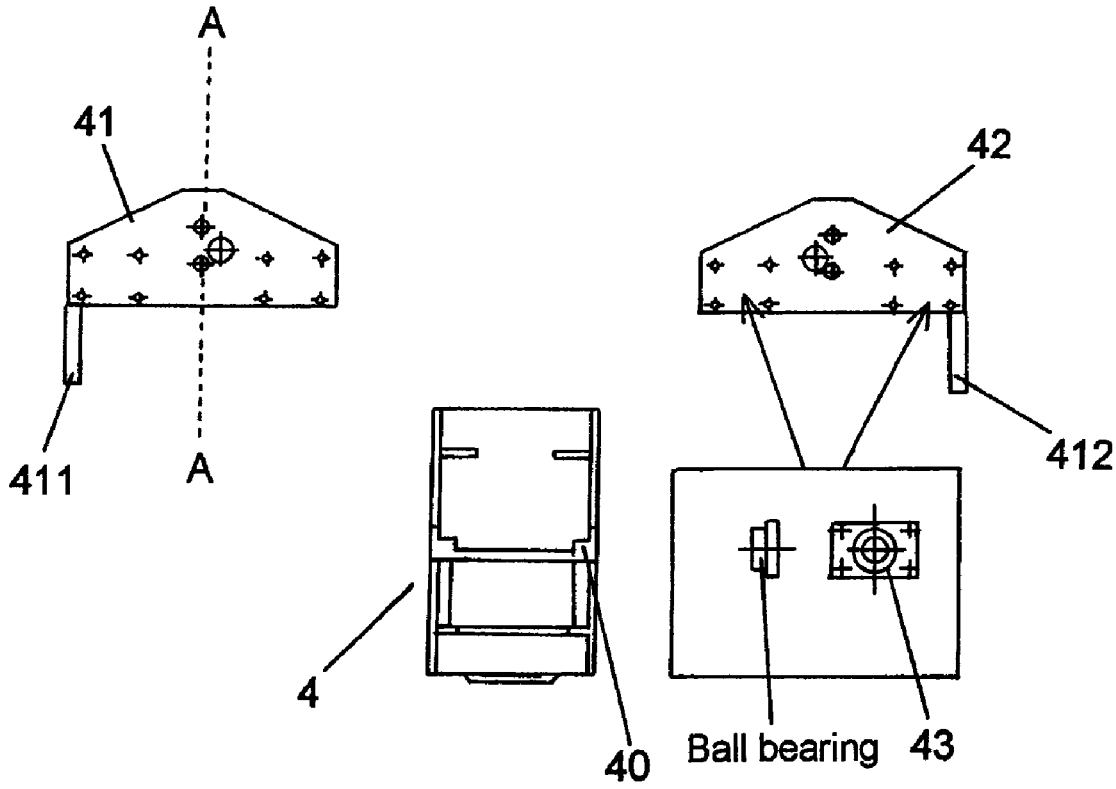
FIG. 12 is an exploded view of the rails which perform the sliding action of the rotary motor.
Figure 13:
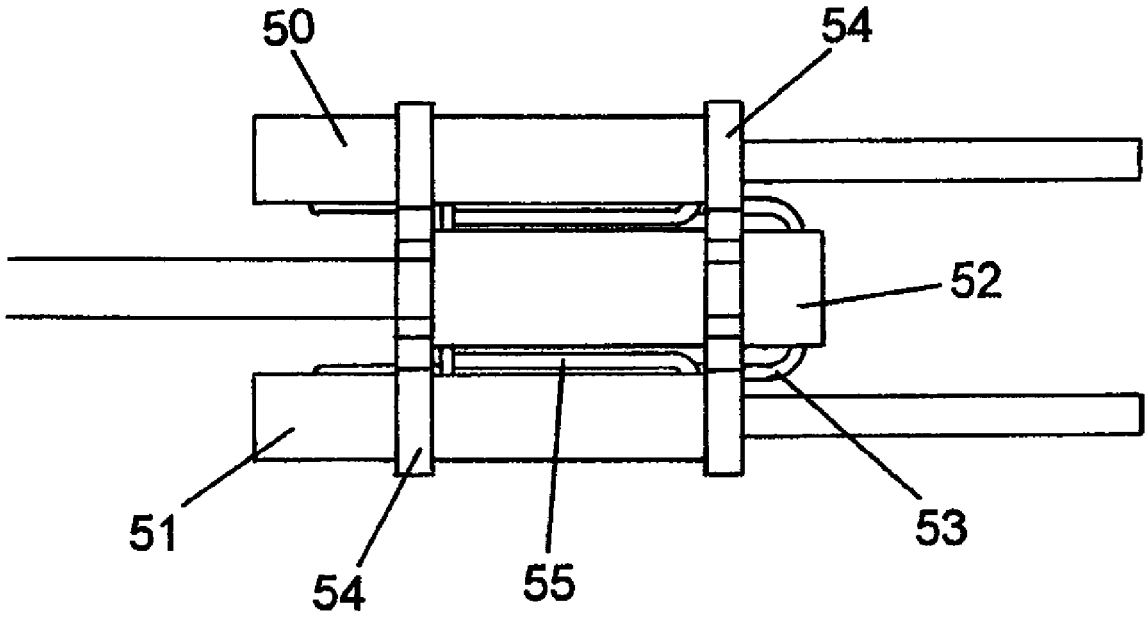
FIG. 13 is a plan view of the jacks used for sliding the rotary motor along the bottom chassis.
Figure 14:
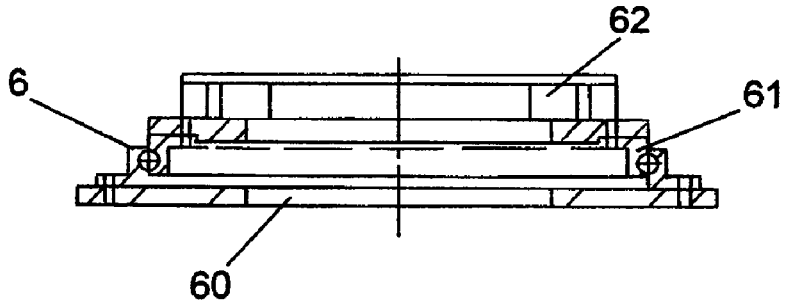
FIG. 14 is a view in section of the turret used for rotation of the chassis in relation to the axis of the arm of the mini-digger.
Figure 15:
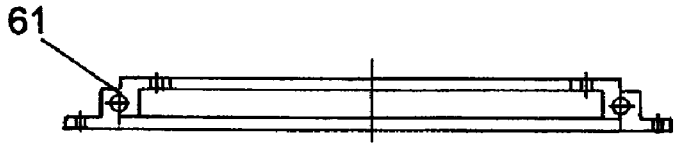
FIG. 15 is a view in profile of a plate constituting the turret.
Figure 16:
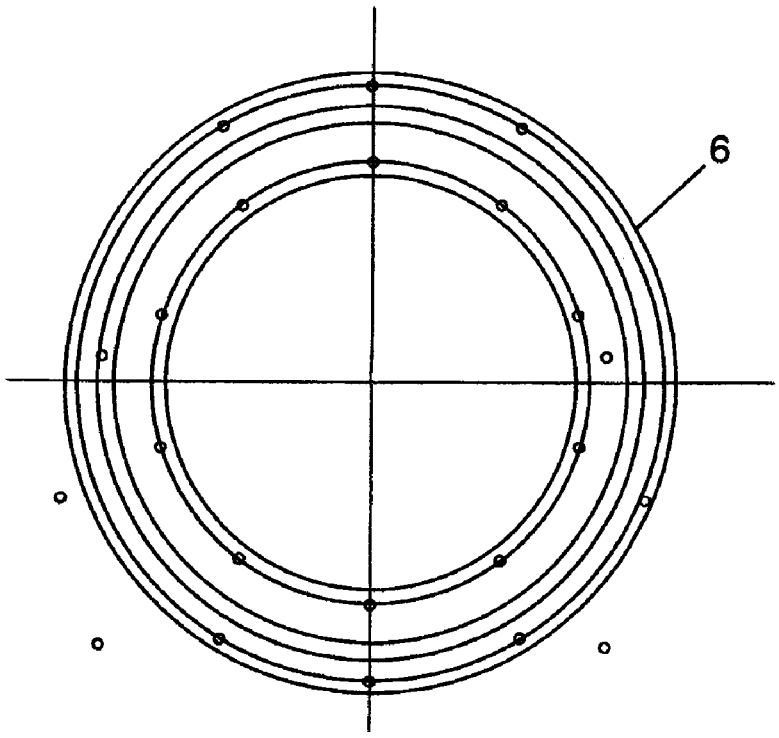
FIG. 16 is a plan view of the turret.
Figure 17:
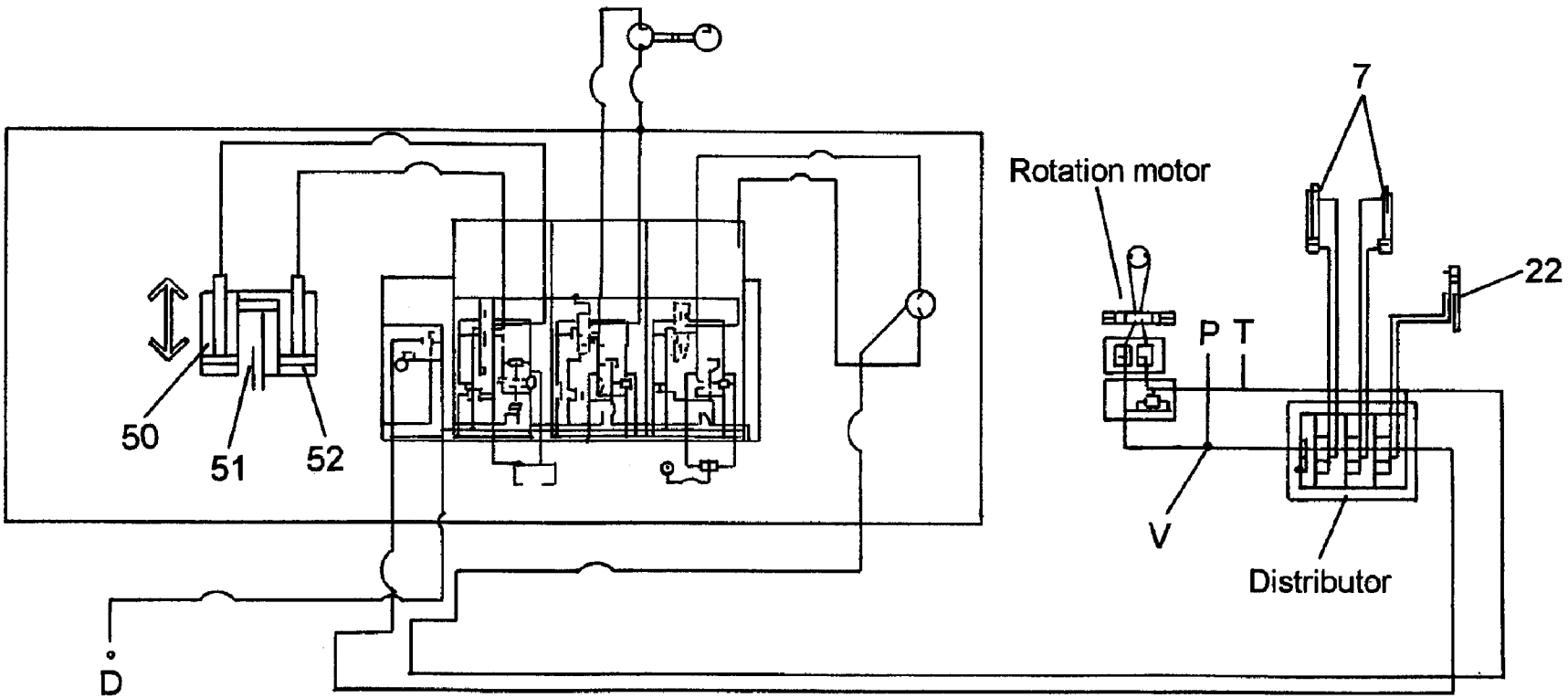
FIG. 17 is the diagram of the hydraulic system used for operating the various elements making up the drilling machine according to a preferred embodiment of the invention.
Figure 18:
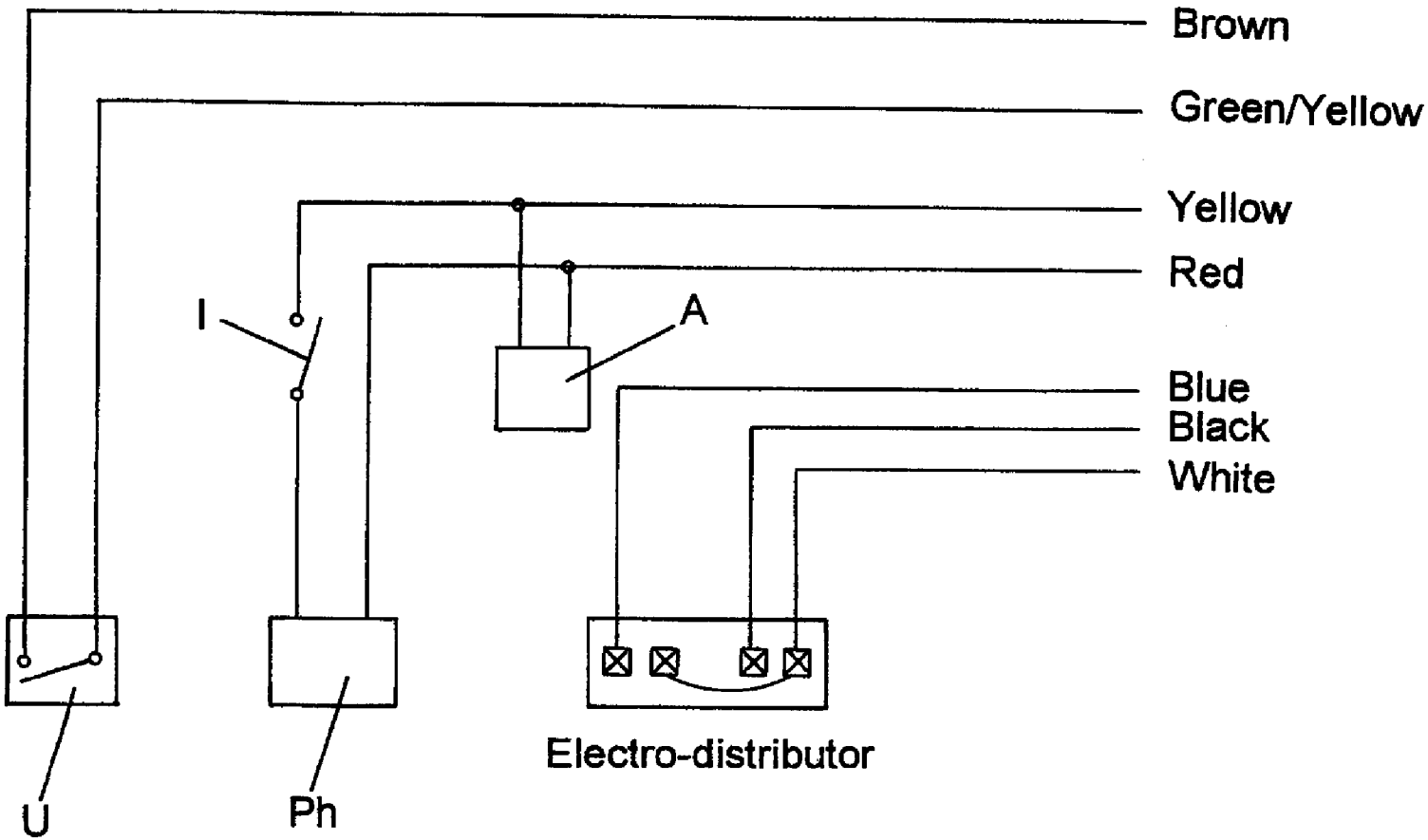
FIG. 18 is the electrical diagram used to operate the various elements of the drilling machine according to a preferred embodiment of the invention.

This present invention concerns a hydraulic drilling machine of small size suitable for use with any hydraulic source, such as a digger, tractor-mounted digger, mini-loader, loader or crane truck, for example, and in a preferred method of implementation, on a small hydraulic digger (not shown in the figures).

The drilling machine is composed of a chassis (1) in the shape of a rectangular parallelepiped. This chassis has the particular quality of having a width of the order of one third of its length. In its upper part, the chassis (1) is connected to the arm of the small hydraulic digger by means of a turret (6) which provides the chassis (1) with a rotary movement around the axis of the arm of the small digger.

In its upper part, the chassis (1) has several metal plates (101, 102) which play the role of supports. The support plate (101) located toward the rear (that is on the side of the small hydraulic digger) of the chassis (1) acts as a support to the water pump (not shown on the diagrams), and the metal plate adjacent to it (102) for its part, acts as support to the hydraulic distributors. A third metal plate (104) is fixed to a cross-member (103) located approximately at mid-height of the chassis (1) in the lengthwise direction. This metal plate (103) acts as support to the control block of the drilling machine.

At the front of the chassis (1), on the outside of one of the edges composed by the uprights of the chassis, two rings (11) are located one below the other. The first ring (11) is located approximately at the same height as the supports (101, 102) of the water pump and of the hydraulic distributors. The second ring is located approximately at mid distance between the cross-member (104) on which the support (103) of the control block is fixed and the cross-member on which the supports (101, 102) of the pump and of the hydraulic distributors are fixed.

The rings (11) thus positioned are used for the retention of a basket (110) intended for the storage of the drilling rods. The basket (110) is composed of three U-shaped metal bands (1101) placed approximately parallel to each other. Cross-members (1102, 1105) hold the bands (1101) in position. These cross-members (1102, 1105) are positioned so as to be approximately perpendicular to the bands (1101) and are located at the lower and upper extremities of the U shape by the bands (1101). At the rear of the basket (110), two fixing lugs (1104) are attached, each to one of the cross-members (1105) facing the central band (1101). These fixing lugs (1104) will fit into the rings (11) located at the front of the chassis (1). The basket (110) is removable.

The drilling resources are located in the bottom part and toward the front of the chassis (1). These resources are composed of a system for locking and unlocking (20, 21, 22) of the rods, necessary for the correct execution of drilling, and resources for pushing and driving the drilling rods, which will be described later.

The resources for locking/unlocking the rods include a drill-bit guide (20), a guillotine (21), an operating jack (22) and slides (23).

The drill-bit guide (20) is a metal part of rectangular shape equipped with a cylindrical bore (201) located approximately at its centre. Two of its corners located at each of the extremities of a given length are chamfered. The drill-bit guide (20) is fixed onto one of the widths of the chassis (1) at the height of the cross-members (12). The chamfered corners of the drill-bit guide (20) facilitate its installation along the chassis (1).

The guillotine (21) is a metal part, also of rectangular shape. On one of its lengths, the guillotine (21) presents two teeth (211, 212) located approximately in the median part of the length of the guillotine. Between these teeth (211, 212) there is a space (213) whose dimensions correspondent approximately to that of the diameter of the rods used for drilling. On the length of the guillotine (21) opposite to that equipped with the teeth (211, 212) is attached the extremity (221) of a jack (22) whose role is to operate the guillotine (21). The second extremity (222) of the jack (20) is fixed onto a cross-member of the chassis (1) located below the basket (110) when the latter is installed on the chassis (1). This jack is used to raise or lower the guillotine as required. During these sliding movements, the guillotine (21) is guided by the slides (23). These slides (23) have an H-shaped section. The finger (231) of the slide (23) is fitted with holes (2311) which will be used to attach the slide (23) along the uprights of the chassis (1). The upright of the chassis (1) is positioned in the recess (230) of the slide (23) while the guillotine slides in the narrowest recess (232).

The guillotine (21) is positioned approximately parallel to the drill-bit guide (20) so that it rubs against the latter during its sliding movement.

When the drilling machine is in operation, the drilling rods are driven in rotation by a hydraulic motor. In order to allow this rotation of the drilling rods, the guillotine (21) is brought to the raised position, and the guillotine jack (22) is then compressed.

When it is necessary to add a rod, in order to allow the advancement of the drilling operation, the guillotine jack (22) is operated and the guillotine (21) lowered. When the guillotine drops down, the drilling rod which passes through the hole (201) of the drill-bit guide (20) is locked in the hole (213) by the teeth (211, 212) of the guillotine. The teeth (211, 212) and hole(213) assembly acts as an adjustable spanner, preventing the rotation of the rod and allowing the attachment a new rod. One then only has to raise the guillotine to free the rod and allow rotation to resume.

At its lower extremity, the chassis (1) is fitted with cross-members (12) positioned along each of its lengths. These cross-members outline a frame in which a bottom chassis (3) is located. This bottom chassis (3) is composed of two cross-members (31, 31') placed approximately parallel to each other at a distance that corresponds approximately to the width of the drill-bit guide (20), to which it is fixed in fact. Opposite to the drill-bit guide (20), a metal plate (32) is fixed between the two cross-members (31, 31'). The plate (32) is equipped with a bore (321) placed approximately at its centre. This hole (321) is used to lighten the plate (32) and to provide access to the pipe which feeds the rotary motor for the rods and the other hydraulic systems. The two cross-members (31, 31') play the role of rails, whose function will be to guide the rotary motor during its to-and-fro movement.

The support (4) of the rotary motor is composed of a metal plate (40) of rectangular shape. A lug (41, 42) is fixed to each of the lengths of the plate (40). A metal part of rectangular shape (411, 412) is attached as an extension to one of the widths of each lug (41, 42). This part is fixed on the lug by one of its widths, and serves to prevent the derailment of the rotary motor support outside of the cross-members (31, 31') when the latter slides parallel to the longitudinal direction of the chassis (1) in the drilling direction. Each lug (41, 42) is equipped with two ball bearings (43). These ball bearings (43) are located symmetrically in relation to the axis of symmetry (AA) of the lugs (41, 42). One of the ball bearings (43) of each lug is located close to the attachment line of a metal part (411, 412). These ball bearings (43) facilitate the movement of the rotary motor along the cross-members (31, 31').

The movement of the rotary motor is rendered possible by the use of three jacks (50, 51, 52). These three jacks are placed approximately parallel to each other and in the same horizontal plane. The jacks (50, 51) furthest to the outside are oriented in the same direction, meaning that their pistons are both fixed on the same part of the bottom chassis (3) which can be either the drill-bit guide (20) or the cross-member (322) located at the external extremity of the plate (32). The central jack (52) is placed so that its piston operates in a manner that is opposite to the pistons of the two external jacks (50, 51), or in other words, when the pistons of the external jacks (50, 51) are pushing, the piston of the central jack (52) operates in traction, and vice versa. The three jacks (50, 51, 52) always operate simultaneously in order to supply more power.

The three jacks (50, 51, 52) are connected together in a rigid manner by various metal parts. In a first stage, the jacks (50, 51, 52) are attached to three metal parts (53, 55) of circular section and made in the shape of a U. Each jack is placed on one of these parts. The legs of the U located between two jacks overlap. In a second stage, the jacks are connected together by at least two metal cross-members (54, 54') positioned so as to be approximately perpendicular to the jacks (50, 51, 52).

The support (4) of the rotary motor is then fixed onto the jacks (50, 51, 52) by means of the metal plate (40) on which the rotary motor rests.

During drilling, the rod rotary motor drives the rods in rotation. To do this, the rotary motor must be positioned at the front of the chassis where the system for locking and unlocking the drilling rods is located. When it is in working position, the rotary motor is moved, by means of the jacks (50, 51, 52), toward the guillotine (21) and the drill-bit guide (20) until it is in contact with them. When it is necessary to add or remove a drilling rod, the rotary motor is driven, by the operation of the jacks (50, 51, 52), toward the rear of the chassis in the direction of the plate (32). Simultaneously, the guillotine jack (22) is operated, and the guillotine (21) drops down along the drill-bit guide (20) in order to lock the rod located in the hole (201) of the drill-bit guide (20). To add a rod, it is only necessary for the rod in contact with the rotary motor to be detached from the latter before it slides toward the rear of the chassis. A free space is thus created between the motor and the rod locked in the drill-bit guide (20) by the guillotine (21). It then remains only to bring up a new drilling rod, which will be locked into the preceding one, and to return the rotary motor to its working position. To remove a drilling rod, it is merely necessary to move back the rotary motor without detaching the rod that was in contact with it. The rod that is to be withdrawn is connected at one end to the rotary motor and at the other to a drilling rod which is locked in the drill-bit guide by the guillotine. When the rod connected to the rotary motor has been unscrewed and withdrawn, the motor is brought to its working position and drives in rotation the rod located in the drill-bit guide and which has first been freed from the guillotine.

The drilling machine has the advantage of being easy to handle. This is due on the one hand to its small dimensions, and in particular its small width, and on the other to the fact that it can operate in a wide variety of positions.

In one preferred method of implementation, the drilling machine is fixed to the arm of a hydraulic mini-digger. This allows the drilling machine to be able to operate in the various inclined positions made possible by the perpendicular movement driven by the jacks on the arm of the digger.

The drilling machine is connected to the arm of the mini-digger by means of a turret (6). This turret is composed of at least three metal plates (60, 61, 62) in the shape of a crown. Plate 60 is the one with the largest diameter, and is fixed to the top of the chassis (1). Plate 61, whose outside diameter is less than that of plate 60, is attached to the latter. Plate (61) is hollow. Finally, plate (61) is surmounted by a final plate (62) of smaller outside diameter than plate (61). The inside diameters of the three plates (60, 61, 62) are identical, and the passage that they create within the turret (6) is used to insert pipes whose function is to feed oil into the hydraulic circuit of the drilling machine.

The turret provides the drilling machine with a rotating motion around the axis the mini-digger arm. This movement is rendered possible by the presence of gears in the turret.

The ease of handling of the drilling machine necessitates the presence of stabilization resources, so that drilling can take place in optimum conditions.

To do this, the drilling machine is equipped with support devices (7). These support devices (7) are jacks placed on either side of the chassis (1) along the cross-members (12). The support devices (7) are attached by a metal plate (70) bolted to the cross-members (12). These plates (70) hold the support devices (7) by means of metal rings (71) which surround the support devices and which are fixed to the metal plates (70). Each support device (7) is thus held by at least two rings (71). The extremity (72) of the pistons of the support devices (7) is free. It ends in a metal sphere (721). These spheres (721) are clamped into cylindrical parts (73) whose support (731) is a plate which allows the support devices of obtain purchase on various supports such as the blade of the mini-digger or indeed the edge of an excavation effected in the ground, at the bottom of which hole must be drilled. The parts (73) are fitted with of a conduit (732) placed radially and which opens into the chamber where the sphere (721) is located. This conduit (732) is used to inject a lubricant into the chamber in order to facilitate the rotation of the sphere.

The hydraulic system of the drilling machine is fed from the hydraulics of the mini-digger. The liquid from the hydraulics of the mini-digger enters into the hydraulic circuit of the drilling machine via two separate points (P, T) known as conventional points, and via a third point (D) called a drain, which has been added for the requirements of the machine. The conventional entry points (P, T) of the hydraulic circuit end in a quarter-turn valve (V) mounted in shunt between the rotary motor on the one hand and a distributor on the other. The distributor is controlled by the driver of the drilling machine who decides to operate the support devices (7), the guillotine jack (22), or the rest of the circuit, such as, for example, the jacks (50, 51, 52) which permit the sliding action of the rotary motor, or indeed the water pump. Depending on the orientation of the quarter-turn valve (V), the liquid feeds to either the rotary motor, which means that drilling is in progress, or the distributor, which means that support devices are operating and that the driver is stabilizing the drilling machine before beginning work, or if the guillotine jack is operated then a drilling rod is being removed or added. The third input (D) of the hydraulic circuit ends directly in the part of the circuit which controls the jacks (50, 51, 52) which permit the sliding action of the rotary motor, amongst other things. This additional input (D) is used to increase the power of the components in the circuit, and in particular of the jacks (50, 51, 52), even though the invention operates from a small hydraulic source. This additional input (D) enables the use of additional hydraulic units to be avoided.

The electrical circuit of the drilling machine is connected to the control panel of the mini-digger. This circuit includes an emergency stop switch (U), a power feed for the hydraulic distributor, and a power feed for a working lamp (Ph). The power feed of the working lamp (Ph) is equipped with a switch (I). A power feed (A) for the vehicle-mounted electronics is mounted as a take-off from the power feed of the working lamp. The working lamp is not fed directly by the mini-digger but by means of a cigar lighter mounted on the chassis (1) of the drilling machine. This arrangement is enables one to dispense with the use of a battery in order to operate the vehicle-mounted electronics.

The vehicle-mounted electronics consist of resources for transmission to the driver of the drilling machine of such information as the drilling depth, the nature of the ground or the orientation of the drilling head, amongst other things.

At the beginning of the drilling operation, the first drilling rod (80) used is equipped with a drilling head (81). The drilling head (81) has the shape of a duckbill, which allows it to drill into the ground. This head (81) is also equipped with a vehicle-mounted electronics system which allows it to return to the operator all of the information needed for the execution of the works, such as the depth at which it is located, for example. This system is known, and it can consist of an "Eclipse" reference probe of Digitrack make, for example.

When it is advancing linearly, the drilling head (81) rotates. If the trajectory of the head has to be modified, the operator who is controlling the operation operates a hydraulic control which stops the rotation of the drilling head (81) and applies a push force to it. The orientation of the duckbill of the drilling head (81) at the moment of application of the push force determines the direction in which drilling will continue. In fact, if the duckbill is orientated at 9 o'clock at the moment of applying of push force, the drilling head (81) will turn to the right, pulling the line of drilling rods (80) after it. Likewise, if the duckbill is oriented to 6 o'clock at the moment of applying the push force, the drilling head (81) digs deeper into the ground, pulling the line of drilling rods (80) after it. The orientation of the duckbill of the drilling head (81) is known to the operator by means of the vehicle-mounted electronics system.

During the drilling operation, water is injected into the rods (80) and into the drilling head (81) in order to facilitate their progress in the ground. In the event of instability of the resulting hole, it is possible to inject foam designed for this purpose and which has properties suitable for stabilization of the ground. This foam does not require any cleaning or recovery operation, unlike other materials such as Betonite for example, because it disappears automatically over time.

It must be obvious, for people who are familiar with these techniques, that this present invention allows implementation in many other specific forms without moving it away from the domain of application of the invention as claimed. As a consequence, the methods of implementation presented should be considered as an illustration, but one that can be modified within the domain defined by the scope of the attached claims, and the invention should not be limited to the details given above.

The invention claimed is:

1. A hydraulic drilling machine comprising a metal chassis shaped as a rectangular parallelepiped having a first lengthwise extremity arranged to be connected to a hydraulic source, drilling resources located in a bottom part of the metal chassis at a second lengthwise extremity opposite to the first lengthwise extremity, the drilling resources including a rotary motor for driving drilling rods during a drilling operation, the drilling rods, when mounted on the rotary motor during a drilling operation, extending in a direction perpendicular to the longest faces of the metal chassis, between the first and second lengthwise extremities, stabilization resources for the position of the drilling machine during a drilling operation mounted on the metal chassis to create a resultant force coaxial to the axis of drilling resources including the rotary motor and the drilling rods when connected to the rotary motor during a drilling operation, and further resources arranged to be mounted on an arm of a hydraulic mini-digger arranged to be connected at the first lengthwise extremity, the further resources being capable of operation without the addition of an extra hydraulic unit, wherein the drilling resources include a system for locking and unlocking the drilling rods, the system for locking and unlocking including a drill-bit guide along which can slide a guillotine, the guide being arranged to be driven by two slides in turn arranged to be driven by a guillotine jack.

2. A hydraulic drilling machine according to claim 1, wherein the drill-bit guide is a metal part having rectangular shape including a centre bore allowing passage of the drilling rods, the guide being fixed at the bottom part of one of the widths of the chassis at the height of cross members positioned at the lower extremity of the metal chassis along each of the metal chassis lengths.

3. A hydraulic drilling machine according to claim 2, wherein the guillotine has a rectangular shape, one side of the guillotine includes two teeth separated by a space having a size approximately equal to that of the diameter of a drilling rod for enabling the drilling rods to be locked between the teeth.

4. A hydraulic drilling machine according to claim 3, wherein the guillotine is positioned approximately parallel to the drill-bit guide in such a way that the guillotine rubs up against the drill-bit guide.

5. A hydraulic drilling machine according to claim 4, wherein the guillotine is arranged to be operated by a jack having a first extremity fixed on a length of the guillotine which has no teeth, and a second extremity fixed on a cross-member of the chassis.

6. A hydraulic drilling machine according to claim 1, wherein the guillotine is arranged to move along slides attached along uprights of the chassis, the upright having an H-shaped section.

7. A hydraulic drilling machine comprising a metal chassis shaped as a rectangular parallelepiped having a first lengthwise extremity arranged to be connected to a hydraulic source, drilling resources located in a bottom part of the metal chassis at a second lengthwise extremity opposite to the first lengthwise extremity, the drilling resources including a rotary motor for driving drilling rods during a drilling operation, the drilling rods, when mounted on the rotary motor during a drilling operation, extending in a direction perpendicular to the longest faces of the metal chassis, between the first and second lengthwise extremities, stabilization resources for the position of the drilling machine during a drilling operation mounted on the metal chassis to create a resultant force coaxial to the axis of drilling resources including the rotary motor and the drilling rods when connected to the rotary motor during a drilling operation, and further resources arranged to be mounted on an arm of a hydraulic mini-digger arranged to be connected at the first lengthwise extremity, the further resources being capable of operation without the addition of an extra hydraulic unit, wherein the rotary motor is fixed to a support including a metal plate having a lug along each of its lengths, the lug including two ball bearings located on opposite sides of an axis of symmetry of the lugs, further including three, and not more than three, jacks for causing the sliding action of the rotary motor support, the three jacks being located approximately parallel to each other in the same horizontal plane, and head to foot so that all three of the jacks are arranged to simultaneously move the support in the same direction, two of the three jacks being located adjacent the head of and on opposite sides of the support and the third jack being located adjacent the foot of the support between opposite sides of the support, the three jacks being arranged so the direction they translate the rotary motor is the same direction as the direction the drilling rods are translated by the rotary motor.

8. A hydraulic drilling machine according to claim 7, wherein the jacks are connected together in a rigid manner by three metal parts having a circular cross section and in the shape of a U, and by at least four cross-members on which the metal plate rests.

* * * * *